US006913669B2

(12) United States Patent
Ensinger

(10) Patent No.: US 6,913,669 B2
(45) Date of Patent: Jul. 5, 2005

(54) RETAINING RING FOR HOLDING SEMICONDUCTOR WAFERS IN A CHEMICAL MECHANICAL POLISHING APPARATUS

(75) Inventor: Wilfried Ensinger, Nufringen (DE)

(73) Assignee: Ensinger Kunststofftechnologie GBR, Nufringen (DE)

( * ) Notice: Subject to any disclaimer, the term of this patent is extended or adjusted under 35 U.S.C. 154(b) by 100 days.

(21) Appl. No.: 10/322,427

(22) Filed: Dec. 19, 2002

(65) Prior Publication Data

US 2004/0065412 A1 Apr. 8, 2004

(30) Foreign Application Priority Data

Oct. 2, 2002 (DE) ..... 102 47 179

(51) Int. Cl.[7] ..... B24B 47/02
(52) U.S. Cl. ..... 156/345.14; 451/397
(58) Field of Search ..... 156/345.14; 451/397

(56) References Cited

U.S. PATENT DOCUMENTS

| | | | |
|---|---|---|---|
| 4,212,137 | A | 7/1980 | Rue |
| 5,643,061 | A | 7/1997 | Jackson et al. |
| 5,695,392 | A | 12/1997 | Kim |
| 5,993,302 | A | 11/1999 | Chen et al. |
| 6,030,280 | A | 2/2000 | Fruitman |
| 6,068,548 | A | 5/2000 | Vote et al. |
| 6,186,880 | B1 | 2/2001 | Gonzalez et al. |
| 6,251,215 | B1 | 6/2001 | Zuniga et al. |
| 6,264,540 | B1 | 7/2001 | Fruitman |
| 6,277,008 | B1 | 8/2001 | Masuta et al. |
| 6,354,927 | B1 | 3/2002 | Natalicio |
| 6,390,904 | B1 | 5/2002 | Gleason et al. |
| 6,390,908 | B1 | 5/2002 | Chen et al. |
| 6,439,984 | B1 | 8/2002 | Andres |
| 6,471,566 | B1 | 10/2002 | Mikhaylich et al. |
| 6,585,850 | B1 | 7/2003 | Kenji et al. |
| 2002/0049030 | A1 | 4/2002 | Numoto et al. |

FOREIGN PATENT DOCUMENTS

| | | |
|---|---|---|
| DE | 198 27 308 | 12/1999 |
| EP | 0 747 167 | 12/1996 |
| EP | 0 841 123 | 5/1998 |
| JP | 2001121411 | 5/2001 |

OTHER PUBLICATIONS

"Mubux–A® Einpress–GewindeEinsatz/Gewindestift . . . ", Kerb Konus, pp. 15–16.
"Soniclok®—Gewinde–Enwsatz und Gewinde–Stift . . . ", Kerb Konus, pp. 22–23.
"der Ensat®—selbstschneidender GewindeEinsatz . . . ", Kerb Konus, pp. 4–5, and 8.
Kerb–Konus Data Sheet, 2 pages.
U.S. Appl. No. 10/322,428, filed Dec. 19, 2002, Ensinger.

*Primary Examiner*—Gregory Mill
*Assistant Examiner*—Sylvia R. MacArthur
(74) *Attorney, Agent, or Firm*—Leydig, Voit & Mayer, Ltd.

(57) ABSTRACT

A retaining ring to be fitted on a chemical mechanical polishing apparatus for semiconductor wafers is disclosed, the retaining ring comprising a carrier ring made of a first material and having fitting elements for fitting the carrier ring on the polishing apparatus; and a bearing ring comprising a plastic material, arranged concentrically on the carrier ring, the bearing ring resting with a first front side on a polishing surface of the polishing apparatus and being held on its side axially opposed to the first front side releasably, non-rotatably, with a positive and/or frictional connection and without adhesive on the carrier ring; wherein the first material has a higher rigidity than the plastic material of the bearing ring.

28 Claims, 11 Drawing Sheets

10
12
14
16
18
20
22
24
A
A'

30
32
34
36
38
40
42
43
44
45
A
A'

50
52
54
56
58
60
62
64
66
68
69
A
A'

70
72
74
76
78
80
82
84
85
86
87
A
A'

90
92
94
96
98
100
102
103
104
106
A
A'

110
112
114
116
118
120
122
124
126
A
A'

130
132
133
134
136
137
138
139
140
142
A
A'

150
152
154
156
158
160
162
164
153
A
A'

170
184
A
172
174
182

172
174
182
170
174
172

179
180
178

170
A'

190
192
194
196
198
199
200
202
204
206
208
A
A'

210
212
214
216
218
A
A'
221
222
223
224
225
226
227
228
230
232

RETAINING RING FOR HOLDING SEMICONDUCTOR WAFERS IN A CHEMICAL MECHANICAL POLISHING APPARATUS

CROSS-REFERENCE TO RELATED PATENT APPLICATIONS

This patent application claims the benefit of German Patent Application No. 102 47 179.7, filed Oct. 2, 2002, which is incorporated by reference.

FIELD OF THE INVENTION

The invention relates to a retaining ring for holding semiconductor wafers in a chemical mechanical polishing apparatus.

BACKGROUND OF THE INVENTION

Nowadays, integrated circuits are typically formed on semiconductor substrates, particularly silicon wafers, by the sequential deposition of conductive, semiconductive and insulative layers on the wafer. After deposition of each layer, etching is performed to create the circuitry functions. After a series of layers have been sequentially deposited and etched, the uppermost surface of the semiconductor substrate, i.e., the outer surface of the substrate, becomes increasingly non-planar. This non-planar surface presents problems in the photolithographic steps of the integrated circuit fabrication process. Therefore, there is a need to periodically planarize or level off the semiconductor substrate surface.

So-called chemical mechanical polishing (CMP) is one of the accepted methods for this. This planarization method typically requires that the substrate, i.e., the semiconductor wafer, be mounted on a carrier or polishing head. The exposed surface of the substrate is then pressed against a rotating polishing pad. A controlled force is exerted on the substrate via the carrier head to press the substrate against the polishing pad. A polishing agent containing at least one chemically reactive substance and abrasive particles is supplied to the surface of the polishing pad.

A recurring problem in the CMP process is the so-called edge effect, i.e., the tendency to polish the edge of the substrate at a different rate than the center of the substrate. This typically results in over-polishing at the edge, i.e., the removal of too much material from the edge, particularly at the outermost 5 to 10 mm of a wafer of 200 mm in diameter.

Over-polishing reduces the overall flatness of the substrate and makes the edge of the substrate unsuitable for integrated circuit fabrication and therefore decreases the process yield.

To solve this problem, U.S. Pat. No. 6,251,215 discloses a retaining ring be made of two portions, a first portion being made of a rigid material, namely a metal portion, and a second portion of a plastic material, which is less rigid, so that, on the one hand, it can be subjected to abrasion, and, on the other hand, it will not damage the semiconductor wafer when contacting it.

Owing to the edge conditions that prevail in chemical mechanical polishing, U.S. Pat. No. 6,251,215 discloses that the plastic portion of the retaining ring and the metal ring are bonded to one another with an epoxy adhesive. Alternatively, it is disclosed that the two portions are joined together with a press fit.

In practice, both solutions prove to be inadequate.

While the plastic portion is held securely on the metal portion when the two portions are bonded with epoxy adhesive, the reconditioning of the retaining ring after the plastic portion has been subjected to a certain amount of abrasion presents problems. The current practice is to send the complete retaining rings to the manufacturer where the plastic portion is mechanically removed and the metal portion is then heated up to approximately 200° C. to thermally decompose the adhesive residues thereon. Subsequently, the metal portion has to be sandblasted in order to remove final residues of the adhesive, and only then can a new plastic ring be adhesively attached thereto.

Owing to this time-consuming and costly procedure, the retaining rings as such become very expensive. In addition, the metal portions, which are more expensive to produce than the plastic portions, only withstand a small number of cycles of reconditioning, in particular, on account of the temperature treatment for thermal decomposition of the adhesive and the sandblasting treatment that is subsequently required.

Exchanging a used plastic ring when metal and plastic portions are joined with a press fit is easier, but a press fit for joining the plastic and metal portions has proven unsuitable for reliably withstanding the forces that occur during the polishing process.

The present invention, relating to a retaining ring that can be manufactured more cost-effectively and, in particular, fitted more cost-effectively with a new plastic part, provides for ameliorating at least some of the disadvantages of the prior art. These and other advantages of the present invention will be apparent from the description as set forth below.

BRIEF SUMMARY OF THE INVENTION

In an embodiment, the invention provides a retaining ring comprising a carrier ring made of a first material and having fitting elements for fitting the carrier ring on the polishing apparatus; and a bearing ring made of a plastic material and arranged concentrically on the carrier ring, the bearing ring resting with a first front side on a polishing surface of the polishing apparatus and being held at its side axially opposed to the first front side releasably, non-rotatably, with a positive and/or frictional connection and without adhesive on the carrier ring; the first material having a higher rigidity than the plastic material of the bearing ring.

DETAILED DESCRIPTION OF THE INVENTION

Figures 1A, 1B, 1C, 1D:
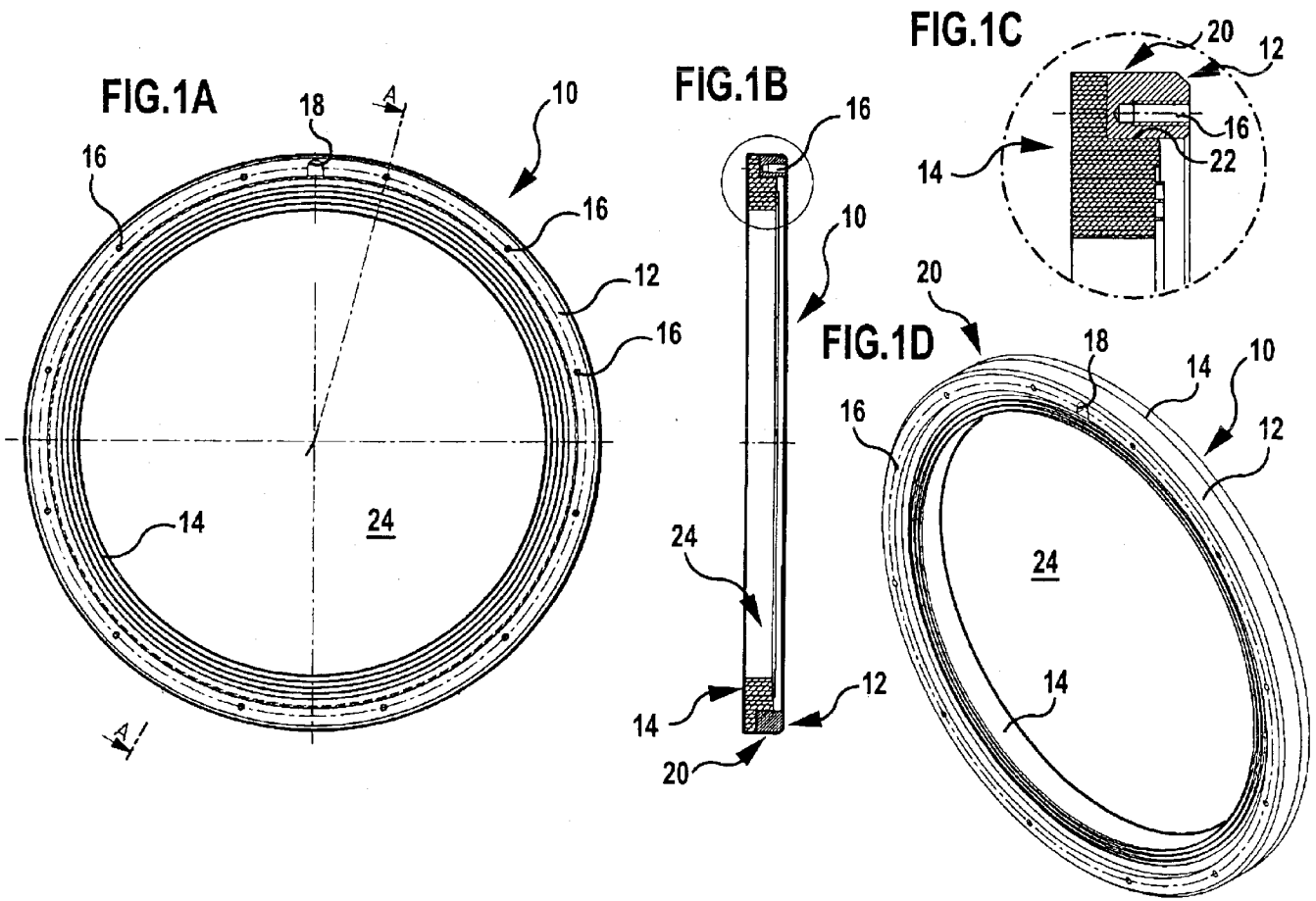
FIGS. 1A to 1D show a first embodiment of a retaining ring according to the invention.

In accordance with an embodiment of the present invention, a retaining ring comprises a carrier ring made of a first material and having fitting elements for fitting the carrier ring on the polishing apparatus; and a bearing ring made of a plastic material and arranged concentrically on the carrier ring, the bearing ring resting with a first front side on a polishing surface of the polishing apparatus and being held at its side axially opposed to the first front side releasably, non-rotatably, with a positive and/or frictional connection and without adhesive on the carrier ring; the first material having a higher rigidity than the plastic material of the bearing ring.

The releasable, non-rotatable, positive and/or frictional connection of bearing ring and carrier ring in the retaining ring according to the invention is preferably made in the area of an outer circumferential surface of the bearing ring. This allows optimum conditions for absorbing the forces acting on the carrier ring during the chemical mechanical polishing process.

The bearing ring is seated particularly securely on the carrier ring when the bearing ring has on the side towards the carrier ring a step which follows the circumference and receives the carrier ring therein. The circumferential surface for establishing the positive and/or frictional connection is then a circumferential surface of the step. The step can extend right around the circumference or consist of ring-segment-like step areas disposed over the circumference.

The carrier ring with its outer circumferential surface will preferably be substantially in alignment with the outer circumferential surface of the bearing ring. The carrier ring is thereby protected to a large extent from soiling and, in particular, also from subsequent corrosion problems because the surfaces of the carrier ring pointing towards the polishing surface are covered by the bearing ring.

In a variant of the retaining ring according to the invention, provision may be made for the bearing ring to have a flange extending around the circumference, projecting radially outwardly and enlarging the bearing surface of the front side of this ring. This outwardly projecting flange of the bearing ring offers the carrier ring additional protection against soiling during the chemical mechanical polishing process. In particular, the idea of designing the carrier ring, which is more expensive to manufacture, as a part which will last as long as possible and be reusable, and of only exchanging the bearing ring regularly as required by its state of wear, is thereby realized in an economic form.

In this variant of the retaining ring according to the invention, provision may be made, depending on the rigidity of the material of the bearing ring, for the carrier ring to also comprise an outwardly projecting flange for stabilizing the flange of the bearing ring in its geometrical shape. Depending on what rigidity the material of the bearing ring exhibits, the flange of the carrier ring may support the flange of the bearing ring partially or also over its entire surface.

Provision is made in a further preferred embodiment of the present invention for the bearing ring and the carrier ring to lie in the joined state surface-to-surface against one another in predetermined surface portions, and for the bearing ring and the carrier ring to have complementary projections and recesses for centering the bearing ring and the carrier ring. In particular, when fitting the bearing ring on the carrier ring, this helps to achieve exact concentric arrangement and thereby also facilitates the exchanging of worn bearing rings.

The surface portions on which bearing ring and carrier ring lie surface-to-surface against one another preferably have a radial orientation and form a planar base and hence support for the bearing ring on the carrier ring.

Alternatively, a slightly conical configuration of these surface portions is also conceivable without any major disadvantages.

The complementary projections and recesses of bearing ring and carrier ring for centering the bearing ring with respect to the carrier ring are preferably arranged in the area of the surface portions on which carrier ring and bearing ring lie surface-to-surface against one another.

In a further preferred embodiment, the complementary projections and recesses of bearing ring and carrier ring may be used for making a connection with a press fit.

In yet another preferred embodiment provision is made for the bearing ring to have at its outer circumference a circumferential collar pointing in axial direction away from the first front side, resting against the outer circumferential surface of the carrier ring and covering the carrier ring over substantially the entire surface thereof. This embodiment has the advantage that the material of the carrier ring is shielded even better from influences of the chemical mechanical polishing process, which permits a larger choice of materials for manufacturing the carrier ring. At the same time, an exact centering can be ensured by the circumferential collar of the bearing ring. It is also conceivable to design the collar for a press fit connection with the carrier ring.

Provision is made in an alternative embodiment of the present invention for the carrier ring to have on its surface portion that contacts the bearing ring a ring groove having a substantially axially parallel wall with a threaded section thereon, for the bearing ring to have on its side axially opposed to the first front side one or several projections arranged complementarily to the ring groove and having a threaded section of complementary design to the threaded section of the axially parallel wall of the groove. This makes it possible for the carrier ring to be screwed to the bearing ring, and in one variant the bearing ring has a collar extending around the circumference as projection with a threaded section.

Alternatively, the ring collar may be divided up into several ring segments spaced from one another.

A further alternative for joining bearing ring and carrier ring includes providing these with cooperating detent means which in the fitted state of the rings form a detent connection and secure the rings against axially acting forces in the fitted state. The detent connection is preferably designed so as to simultaneously act as securing means against rotation. To this end, several snap connections may, for example, be disposed over the circumference of the ring, with detent noses engaging individual recesses and thereby preventing rotation of the bearing ring relative to the carrier ring in the snapped-in state.

Provision is made in a further alternative embodiment of the present invention for the carrier ring and the bearing ring to have surface portions of complementary design with which they rest against each other in the fitted state, and for the surface portions to have projections and recesses of complementary design for joining the rings by a shrinking-in or shrinking-on process. Here, too, the connection between bearing ring and carrier ring can simultaneously be secured against rotation by corresponding design of the projections and recesses.

Yet another alternative embodiment of the present invention makes provision for the bearing ring to have on its circumferential surface a ring groove opening radially outwardly, and for the carrier ring to be made up of several ring segments including a flange portion of essentially complementary design to the ring groove and one or several fitting sections which are provided for fitting the carrier ring on the polishing apparatus in axial direction from the side facing away from the bearing surface of the bearing ring.

In the simplest case, the carrier ring consists of two ring segments, i.e., of two ring halves, as it were, which are pushed in radial direction onto the bearing ring. Here the flange portions simultaneously act as the reinforcement of the bearing ring and thereby ensure that it retains its shape. At the same time, the flange portions carry several fitting sections with which the entirety of bearing ring and carrier ring can then be attached to the polishing apparatus. These fitting sections, may, for example, comprise simple bushings with an internal thread.

Alternatively, the flange portions may also have bores with an internal thread into which fitting bolts are directly screwable.

As an alternative to the two ring halves, several ring segments may be disposed over the circumference so as to form the carrier ring. These ring segments do not necessarily have to be directly adjacent to one another, but may be spaced from one another. The size of the spacing between the individual ring segments or their flange portions in circumferential direction depends on the rigidity of the material of the bearing ring.

In a preferred embodiment, the groove is designed so as to have recesses in its groove wall facing axially away from the bearing surface of the bearing ring. Elements of the fitting sections are then radially insertable from the outside into these recesses which point in the direction towards the polishing apparatus. These may, for example, be bushings which are placed on the flange portions. The recesses may, however, also make bores with an internal thread, which are formed in the flange itself, accessible.

An embodiment of the present invention which differs significantly from the previously described embodiments provides for the bearing ring and the carrier ring to have complementary surfaces which in the fitted state are in alignment with one another and form between them a ring channel which is sealed off from the environment by ring-shaped sealing elements, and for the carrier ring to have a closable opening accessible from the outside and leading into the ring channel for evacuation of the ring channel.

Alternatively, the closable opening leading into the ring channel could, of course, also be arranged on the bearing ring. For cost reasons it is, however, preferable to provide this on the carrier ring.

A frictional connection between bearing ring and carrier ring can then be made by evacuation of the ring channel. The bearing ring can be removed and exchanged by simple aeration of the ring channel.

In each embodiment described hereinabove, a securing against rotation is preferably achieved by providing on the bearing ring and the carrier ring on at least one surface portion on which these rings lie against one another, a cavity which is formed by recesses in both the surface of the bearing ring and the surface of the carrier ring. This cavity can then be filled with a curable material. Once the curable material has hardened, this prevents rotational movement between bearing ring and carrier ring. A securing of the carrier ring on the bearing ring and vice-versa in axial direction can also be provided by corresponding design and arrangement of such a cavity.

As an alternative to this, the bearing ring and the carrier ring can be rotationally fixedly connected to one another by a bolt engaging recesses on both the bearing ring and the carrier ring. Here it is preferable to use a threaded bolt which at the same time can then be secured by tightening it in the recess.

Such screw bolts can be inserted in both axial and radial direction into corresponding recesses and similarly serve in any case to prevent rotation.

In a preferred embodiment, the plastic material includes a thermoplastic material, a thermosetting plastic material, an elastomer and/or a plastic composition.

It is advantageous for the plastic material to be a reinforced, in particular a fiber-reinforced, plastic material.

To improve the tribological properties, it has proven expedient to admix abrasion-reducing and/or wear-reducing additives, for example, PTFE, polyimide, molybdenum disulfide, graphite, boron nitride, nanoparticles or the like with the plastic material.

It is of particular advantage for the bearing ring to be made up like a sandwich of at least two layers or components.

Each of the components of the invention will now be described in more detail below, wherein like components have like reference numbers.

FIG. 1A shows in a plan view from the side facing the polishing apparatus a retaining ring 10 according to the invention for assembly on a chemical mechanical polishing apparatus for semiconductor wafers. The retaining ring 10 comprises a carrier ring 12 made of a first material, in particular, metallic materials and/or plastic materials with a stability like that of metallic materials, in particular, fiber-reinforced plastics.

Arranged concentrically on the carrier ring 12 is a bearing ring 14 made of a plastic material. The first material has a higher rigidity than this plastic material.

At regular angular intervals on its side lying towards the polishing apparatus, the carrier ring 12 has threaded bores 16 for attaching the retaining ring to the chemical mechanical polishing apparatus.

On its side pointing towards the polishing apparatus, the carrier ring 12 also has an opening 18 into which a projection (not shown) on the polishing apparatus extends when the retaining ring is fitted on the polishing apparatus, so that provision is always made for a defined assembly position of the retaining ring in the polishing apparatus. This is facilitated, in particular, by the alignment of the threaded bores 16 with corresponding through-holes on the polishing apparatus, through which threaded bolts are screwed into the threaded bores 16 and the retaining ring is thereby attached to the polishing apparatus.

FIG. 1B shows a sectional view of the retaining ring 10 of FIG. 1A along line A—A and elucidates the principle according to which the bearing ring made of plastic material is held without adhesive, releasably, non-rotatably, with a positive and/or frictional connection on the carrier ring. For this purpose, the bearing ring 14 has on its side facing the carrier ring 12 a step 22 set back from the outer circumference 20, as shown in the enlarged, more detailed illustration in FIG. 1C. In order to releasably and non-rotatably join the carrier ring and the bearing ring to one another with a frictional connection, the carrier ring, which, in the given example, is made of steel, is shrunk onto the bearing ring which is made of plastic. The plastic material of the bearing ring is preferably a polyphenylene sulfide material (PPS), a PEEK, PAI, PI, PA, POM, PET or a PBT in pure or modified form. To improve the tribological properties, abrasion-reducing and/or wear-reducing additives, for example, PTFE, polyimide, molybdenum disulfide, graphite, boron nitride, nanoparticles or the like, may be added.

An excellent overall stability is imparted to the retaining ring 10 by the greater rigidity of the steel material of the carrier ring 12, whereas the plastic material of the bearing ring 14 lies slidingly on the abrasion surface of the chemical mechanical polishing apparatus, and the semiconductor wafer is held within the ring space 24 defined by the bearing ring during the polishing process. The advantage of this embodiment resides, in particular, in that the steel ring can be shrunk onto the plastic bearing ring 14, and a frictional, releasable but nevertheless non-rotatable connection is obtained. When the bearing ring 14 is worn, it can be removed very easily from the carrier ring 12 and replaced by a new bearing ring 14. The exchanging procedure is significantly easier than is the case with the prior art, and there is no need for removal of any adhesive residues, etc. There is also no need for the carrier ring 12 to be specially prepared before being equipped with a new bearing ring 14, and it itself therefore undergoes considerably less wear.

The circumferential surface 20 of the retaining ring 10 is substantially free of steps, i.e., the outer circumference of the bearing ring 14 is in alignment with the outer circumference of the carrier ring 12. Owing to the bearing ring 14 extending radially further inwards than the carrier ring 12 and, in addition, receiving the carrier ring 12 in a step 22 (FIG. 1C) set back from the outer circumference 20, the ring space 24 is essentially delimited exclusively by the bearing ring 14. The semiconductor wafer to be polished in the chemical mechanical polishing apparatus therefore only comes into contact with the relatively soft plastic material of the bearing ring 14, which minimizes the risk of damage occurring to the edge of the semiconductor wafer.

FIG. 1D again shows a perspective view of the retaining ring 10, which, in particular, illustrates that the inner space of the retaining ring 10 is mainly delimited by the bearing ring 14.

FIGS. 2A to 2D show a further variant of a retaining ring 30 according to the invention, which, like the retaining ring 10 of FIGS. 1A to 1D, comprises a carrier ring 32 made of steel and a bearing ring 34 made of plastic material. At regular angular intervals, the carrier ring 32 has threaded bores 36 which serve to attach the retaining ring 30 to the chemical mechanical polishing apparatus. An opening 38 ensures a defined assembly position of the retaining ring in the chemical mechanical polishing apparatus by a projection on this apparatus engaging the opening 38 in the fitted state. The threaded bores 36 are therefore in alignment with the corresponding attachment elements on the polishing apparatus, and the fitting can then be carried out in a simple way with screw bolts. The outer circumference of the retaining ring 30 is designed such that the outer circumferential surfaces of carrier ring 32 and bearing ring 34 are in alignment with one another. The bearing ring 34 extends in a radial direction further towards the center than is the case with the carrier ring 32.

Figures 2A, 2B, 2C, 2D:
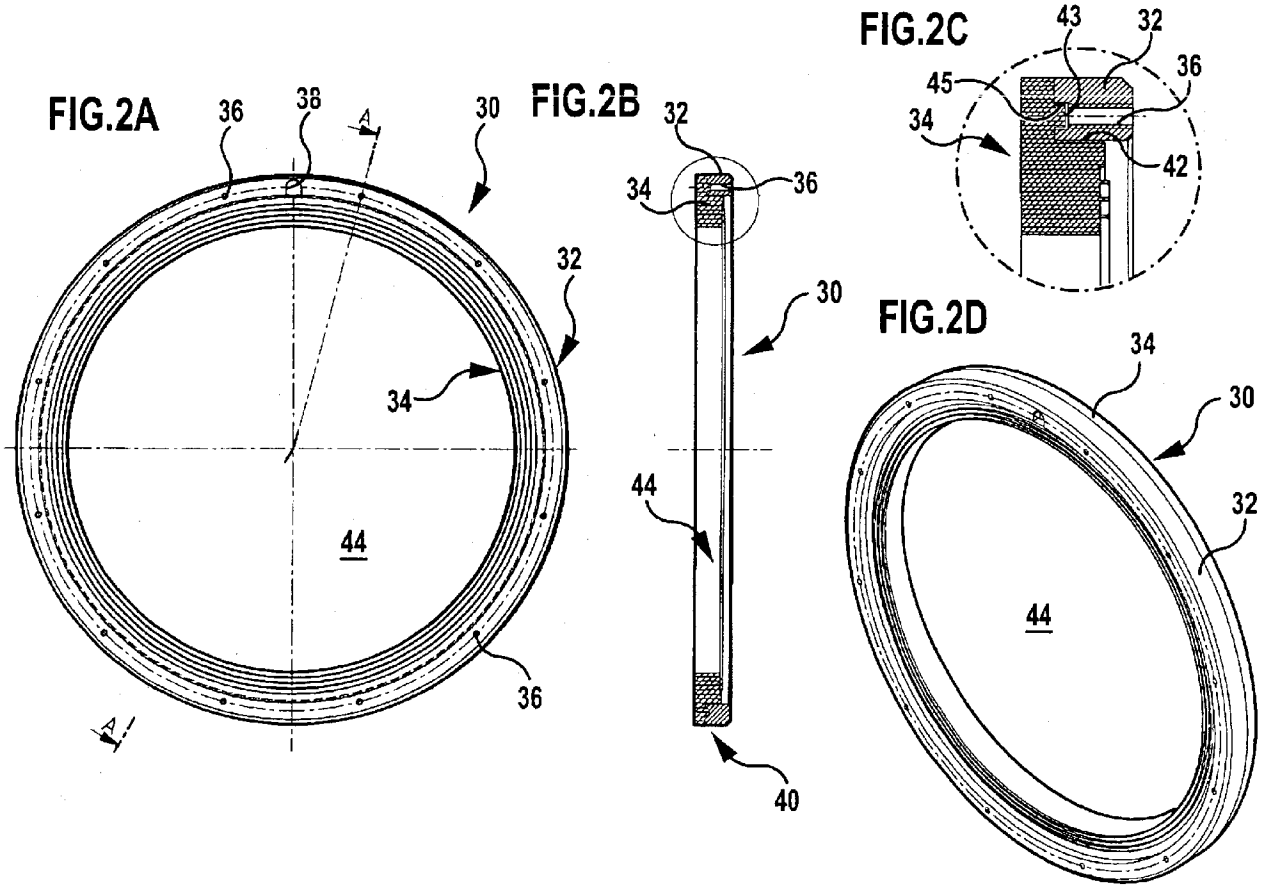
FIGS. 2A to 2D show a further embodiment of the retaining ring according to the invention.

A step 42 set back from the outer circumference 40 is provided on the bearing ring 34 for receiving the carrier ring 32 (FIG. 2C). Therefore, an inner space 44 formed by the retaining ring 30 is again essentially delimited exclusively by the bearing ring 34, i.e., by its relatively soft plastic material. As shown in FIG. 2B, this is apparent from the sectional view taken along line A—A in FIG. 2A. This is also illustrated, in particular, in FIG. 2D. In the area of the step 42, the bearing ring 34 has on its radial surface contacting the carrier ring 32 a ring-shaped rib 43 which engages a complementary ring groove 45 on the underside of the carrier ring 32.

In this embodiment of the retaining ring according to the invention, the connection between the bearing ring 34 and the carrier ring 32 can be made with a press fit by the ring-shaped rib 43 being pressed into the ring groove 45.

The carrier ring and the bearing ring are thereby joined with a positive and frictional connection, which results in a non-rotatable connection without adhesive. This connection is releasable in the event of abrasive wear of the bearing ring 34, and the carrier ring 32 can be equipped with a new bearing ring 34 with a press fit without the carrier ring 32 having to be prepared to any great extent for the insertion of the new bearing ring 34. In particular, the troublesome removal of adhesive residues, as is necessary in the prior art and also results in wear of the carrier ring itself, is dispensed with.

Owing to the inventive design of the retaining ring 30, in principle, any number of bearing rings 34 can be used with a single carrier ring 32. The costs for the chemical mechanical polishing of semiconductor wafers can thereby be drastically reduced, in particular, also because the bearing ring 34 as part which is subjected to wear can be manufactured considerably more cost-effectively than the carrier ring 32 which involves relatively high manufacturing expenditure.

With this retaining ring, too, the carrier ring 32 again assumes the task of mechanically stabilizing the ring and thereby ensuring a fixed geometry thereof. The bearing ring 34 with its relatively soft material protects the semiconductor wafers against contact with the carrier ring 32 and thereby obviates damage to the edge of the semiconductor wafers.

A further variant of a retaining ring 50 according to the invention is shown in FIGS. 3A to 3D. Here, too, a carrier ring 52 assumes the task of mechanically stabilizing the retaining ring 50 and guaranteeing its exact geometry. It is preferably made of steel.

On its side pointing towards the bearing surface of the chemical mechanical polishing apparatus, the carrier ring 52 carries a bearing ring 54 which again is made of plastic material.

On its side lying towards the polishing apparatus, the carrier ring 52 has at regular angular intervals threaded bores 56 via which the retaining ring 50 can be joined by threaded bolts to the polishing apparatus. The carrier ring 52 also has on its side facing the polishing apparatus an opening 58 for defined insertion of the retaining ring 50 in the chemical mechanical polishing apparatus, so that the threaded bores 56 align with corresponding through-holes on the polishing apparatus and screw bolts can be easily inserted and screwed in here.

Figures 3A, 3B, 3C, 3D:
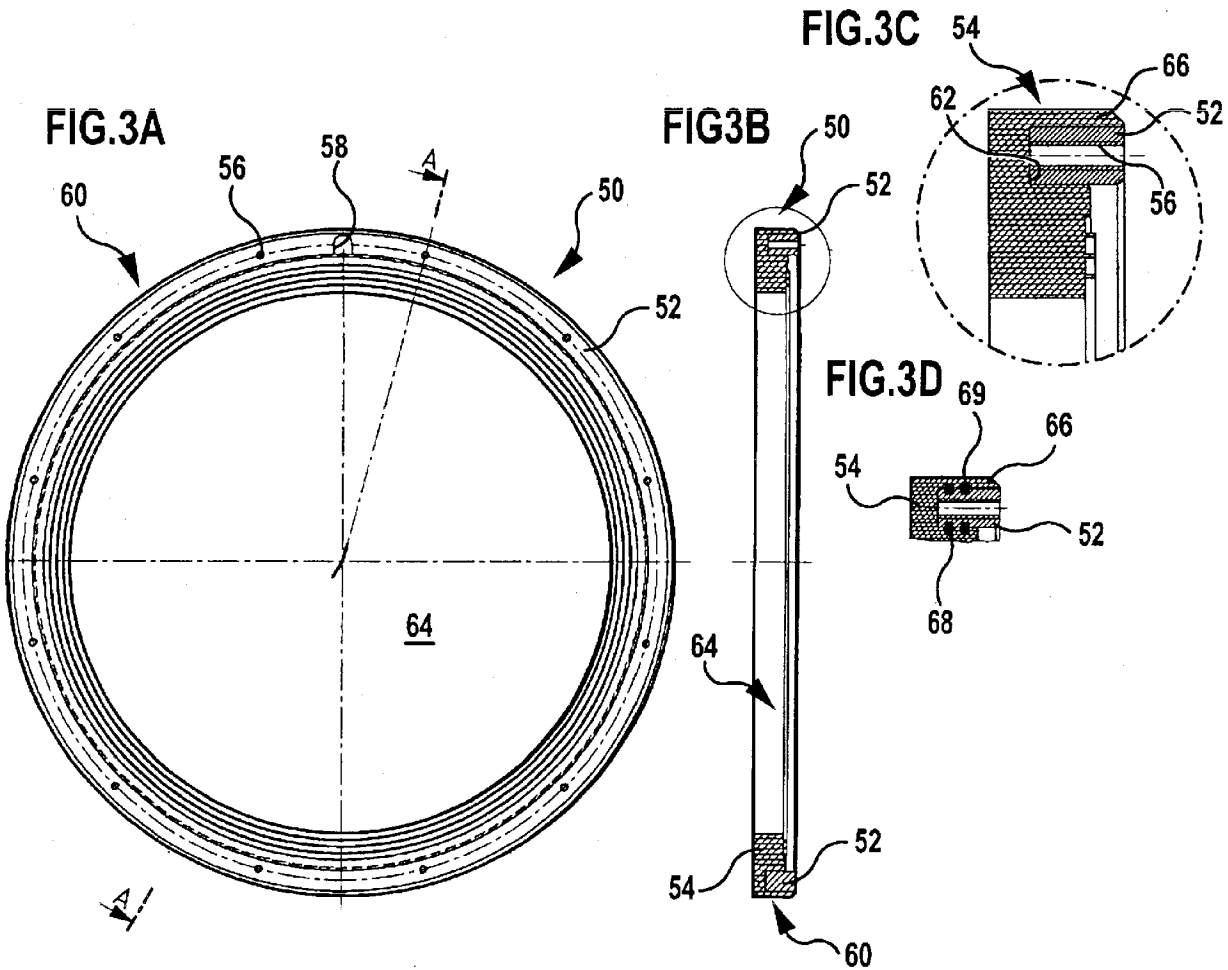
FIGS. 3A to 3D show a further embodiment of the retaining ring according to the invention.

FIG. 3B shows a sectional view of a retaining ring 50 according to the invention taken along line A—A of FIG. 3A. Here it is apparent that the outer circumference 60 of the retaining ring 50 is formed by a collar 66 carried by the bearing ring 54, extending in axial direction and essentially covering the outer circumferential surface of the carrier ring 52 completely. The carrier ring 52 is therefore arranged in a ring channel 62 of the bearing ring 54 and substantially covered by the plastic material of the bearing ring on its surfaces extending in axial direction.

This opens up the possibility for the designer to use a more advantageous metallic material which has the same mechanical properties as the steel material referred to previously, but is more cost-effective, in particular, also for the manufacturing processes of the carrier ring 52. The plastic material of the bearing ring 54 protects the surfaces of the carrier ring 52 in those areas in which it might possibly come into contact with the chemical agents used for the chemical mechanical polishing process. Therefore, corrosion does not occur at the surface of the carrier ring even when more cost-effective materials are used.

In the embodiment of a retaining ring 50 shown in FIG. 3, the carrier ring 52 is joined to the bearing ring 54 with a press fit, so that here again there is an adhesive-free connection. The frictional connection between the carrier ring 52 and the bearing ring 54 is normally sufficient to also ensure a rotationally fixed connection here.

In the event of special stresses, a means for preventing rotation can, however, be provided, as shown by way of example in FIG. 3D. For this purpose, there are provided at one or several locations on the carrier ring 52 and the bearing ring 54 at intervals over the circumference of the retaining ring 50 recesses which together form a cavity which can be filled with a curable organic or inorganic material. When fitting the carrier ring 52 on the bearing ring 54, the material is still soft and shapeable and therefore substantially fills out the cavities formed by the recesses on the bearing ring 54 and the carrier ring 52. The material in the recesses is then cured and thus forms a securing means against rotation. At the same time, a kind of securing means is created to prevent the bearing ring 54 from being readily detachable from the carrier ring 52.

The choice of curable materials as filler 69 for filling the cavity 68 is very wide as these materials are completely shielded from the environment and merely have to meet the mechanical requirements specified by the mechanical strain during the polishing process. It is preferable for thermally curable materials to be used.

In this variant, too, the bearing ring 54 extends so far inwards in radial direction of the retaining ring 50 that the inner space 64 thereby created is substantially delimited by the relatively soft material of the bearing ring 54 and the semiconductor wafers held therein cannot become damaged at their edges during the chemical mechanical polishing process.

The means for preventing rotation in the retaining rings according to the invention as described hereinabove with reference to FIG. 3B can also be applied to the embodiments of the retaining rings 10 and 30, which had already been previously described, and likewise to the majority of the retaining rings discussed hereinbelow, even though specific mention is no longer made of this.

FIGS. 4A to 4D show a further variant of a retaining ring 70 according to the invention, which is essentially comprised of two parts, namely a carrier ring 72 and a bearing ring 74. The carrier ring 72 again has at regular angular intervals threaded bores 76 and an opening 78 whose function corresponds to the threaded bores and openings of the previously described retaining rings. Here, too, the bearing ring 74 extends radially further inwards than the carrier ring 72 and thereby provides an inner space 84 which is substantially delimited by the plastic material of the bearing ring 74 and is therefore gentle on the semiconductor wafers accommodated therein. Here again the outer circumference 80 of the retaining ring 70 is formed by the plastic material of the bearing ring 74 and its collar 86 so that the material of the carrier ring 72 can be selected solely from the point of view of the required stability, irrespective of whether it is sufficiently non-reactive to the chemical agents used in the chemical mechanical polishing process. The collar 86 protects the outer surface of the carrier ring 72 against any possible attack by these materials. In addition, the carrier ring 72 is pressed into a ring channel 82, as is best shown in the detailed illustration in FIG. 4B, which represents a sectional view taken along line A—A in FIG. 4A, and similarly in FIG. 4C.

Figures 4A, 4B, 4C, 4D:
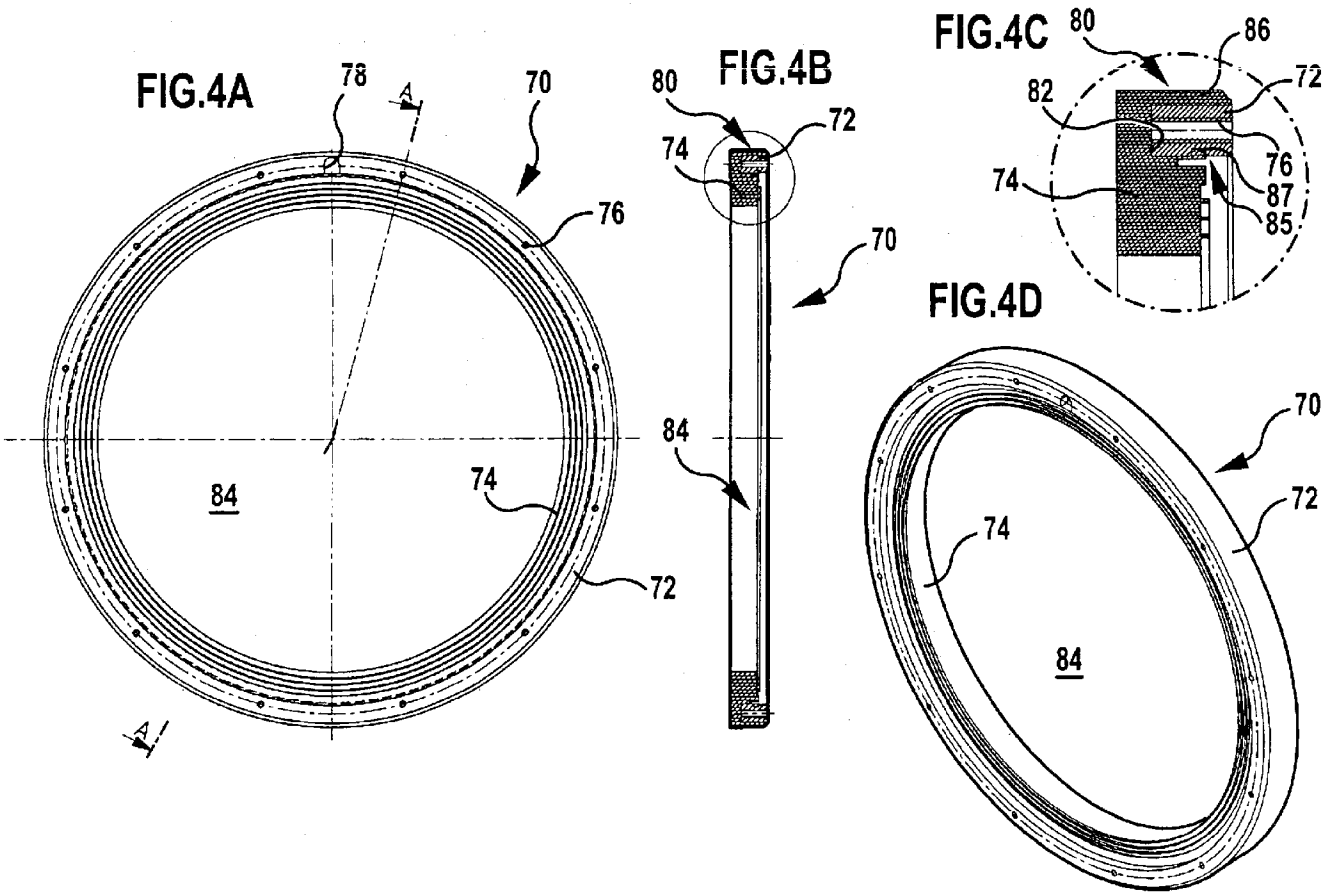
FIGS. 4A to 4D show a further embodiment of the retaining ring according to the invention.

The detailed illustration in FIG. 4C also shows a special feature of this variant of the retaining ring 70, which is otherwise similar in design to the retaining ring 50 of FIGS. 3A to 3D.

A detent connection 85 consisting of a nose 87 held resiliently on the bearing ring 74 and a recess therefor arranged in the inner circumferential wall of the carrier ring 72 is provided on the inner circumferential wall of the ring channel 82 at at least one location, but even better at regular angular intervals over the entire circumference of the ring channel 82.

On pressing the carrier ring 72 into the ring channel 82 of the bearing ring 74, the detent connection 85 engages in the end position, i.e., the nose 87 snaps into the complementary recess on the carrier ring 72 and thereby provides a safeguard against detachment, on the one hand, and establishes a non-rotatable connection between carrier ring 72 and bearing ring 74, on the other hand.

Adequate non-rotational fixing is usually already achieved by pressing the carrier ring 72 into the bearing ring 74, so that the detent connection 85 merely constitutes an additional securing against rotation.

Here, too, it is possible to easily detach the bearing ring 74 from the carrier ring 72 in the event of excessive wear and replace it with a new bearing ring 74. In this case, too, it is not necessary to specially clean or prepare the carrier ring 72 before a new bearing ring 74 can be fitted.

FIGS. 5A to 5D show a further variant of a retaining ring 90 according to the invention. The retaining ring 90 is comprised of a carrier ring 92 and a bearing ring 94, and the carrier ring 92 is again preferably made of steel, and the bearing ring 94 of a plastic material, in particular, of polyphenylene sulfide, PEEK, PAI, PI, PA, POM, PET or of PBT in pure or modified form. Again, abrasion-reducing and/or wear-reducing additives, for example, PTFE, polyimide, molybdenum disulfide, graphite, boron nitride, nanoparticles or the like, may be added to improve the tribological properties.

Here the outer circumference 100 of the retaining ring 90 is formed by the outer surfaces of carrier ring 92 and bearing ring 94 in alignment with one another.

Differently from the variants previously presented, no recessed step is provided on the bearing ring 94, but instead a radial surface 102 which is located opposite the carrier ring 92. This radial surface 102 contains one or several, in the illustrated case five, concentric ring-shaped ribs 103 protruding in axial direction from the radial surface 102. The surface of the carrier ring 92 which is complementary to the radial surface 102 has corresponding concentric undercuts 104 for receiving the ribs 103.

The ribs 103 are preferably incorporated in the undercuts 104 by a shrinking-on or shrinking-in process. Either the metallic material of the carrier ring 92 is first heated so that the undercuts 104 expand, the bearing ring 94 with its ribs 103 is then placed on the carrier ring 92 and the ribs are inserted into the undercuts, and as the carrier ring 92 cools down the undercuts contract and thereby hold the ribs 103 with a positive and frictional connection. Or the plastic material can be cooled down and the ribs 103 inserted into the undercuts 104.

In this way, a positive and frictional connection can be made between the carrier ring 92 and the bearing ring 94 in this variant.

Here, too, the positive and frictional connection provides a safeguard against rotation, which can, however, be further improved, as shown in the previous variants, for example, by provision of further securing means against rotation.

Figures 5A, 5B, 5C, 5D:
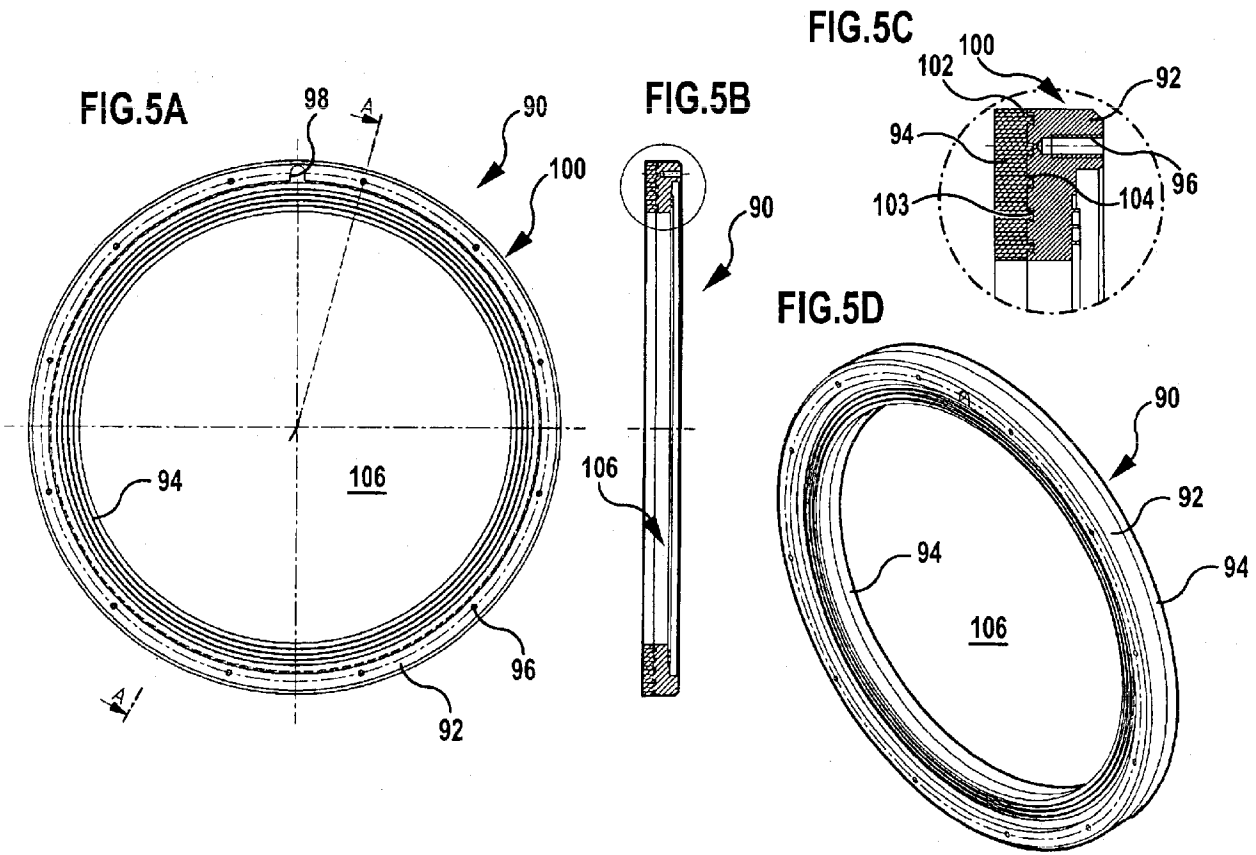
FIGS. 5A to 5D show a further embodiment of the retaining ring according to the invention.

The design of the retaining ring 90 is apparent, in particular, from FIG. 5B, which represents a sectional view taken along line A—A of FIG. 5A, and from the detailed illustration of FIG. 5C.

FIGS. 6A to 6D show a further variant of the retaining ring 110 according to the invention with a carrier ring 112 and a bearing ring 114.

The special feature of this embodiment is that the carrier ring 112 is segmented, i.e., no longer of integral design, as was the case with the previously discussed retaining rings 10, 30, 50, 70 and 90.

Figures 6A, 6B, 6C, 6D:
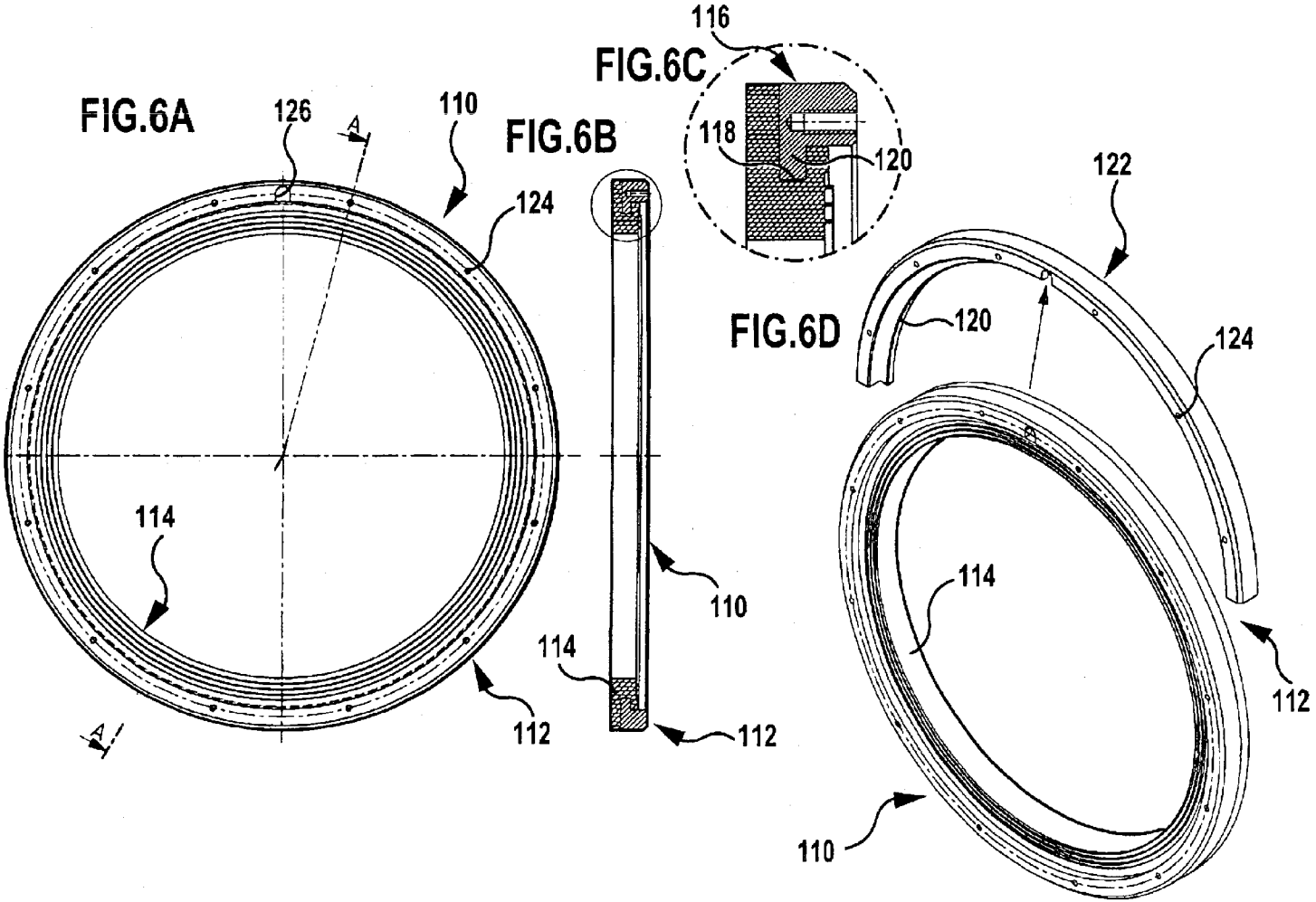
FIGS. 6A to 6D show a further embodiment of the retaining ring according to the invention.

The bearing ring 114 has on its outer circumference a radially recessed step 116 having on its radially outer circumferential wall a ring groove 118 extending radially inwardly. The carrier ring 112 has at its end facing the bearing ring 114 a radially inwardly projecting flange 120 which is pressed into the ring groove 118 of the bearing ring 114 when assembling the retaining ring 110. FIG. 6B shows this in detail in the sectional view taken along line A—A of FIG. 6A. This is also apparent from the enlarged detailed illustration of FIG. 6C.

Finally, FIG. 6D shows the segmentation of the carrier ring 112 into two semicircular segments 122 which together form the carrier ring 112. Here again threaded bores 124 via which the carrier ring 112 can be screwed to the polishing apparatus are provided in the carrier ring segments 122. An opening 126 on the upper side of the carrier ring 112 again ensures a correct assembly position for the retaining ring on the polishing apparatus.

In this variant, separation of the carrier ring 112 from the bearing ring 114 is particularly simple, and, again, no further preparation work is required before connecting a new bearing ring 114 to the carrier ring 112.

FIGS. 7A to 7D show a further variant of a retaining ring 130 according to the invention with a carrier ring 132 and a bearing ring 134. In this variant, the concept of segmentation of the carrier ring 132, as already realized in the embodiment of FIGS. 6A to 6D, is further developed, and a total of 12 segments 133 are present herein (cf, in particular, the spatial illustration in FIG. 7D together with the carrier ring 132).

Figures 7A, 7B, 7C, 7D:
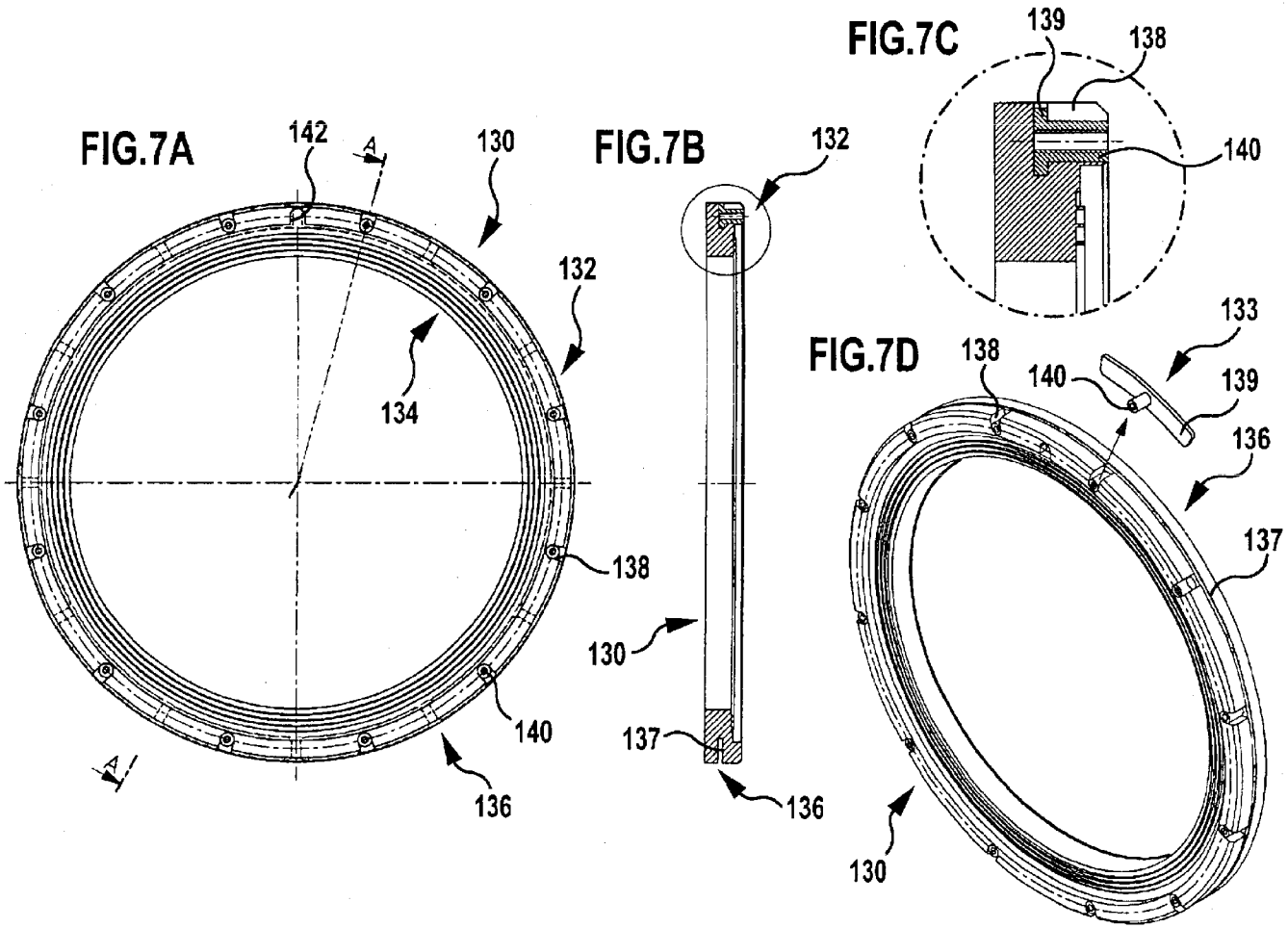
FIGS. 7A to 7D show a further embodiment of the retaining ring according to the invention.
Figures 8A, 8B, 8C, 8D:
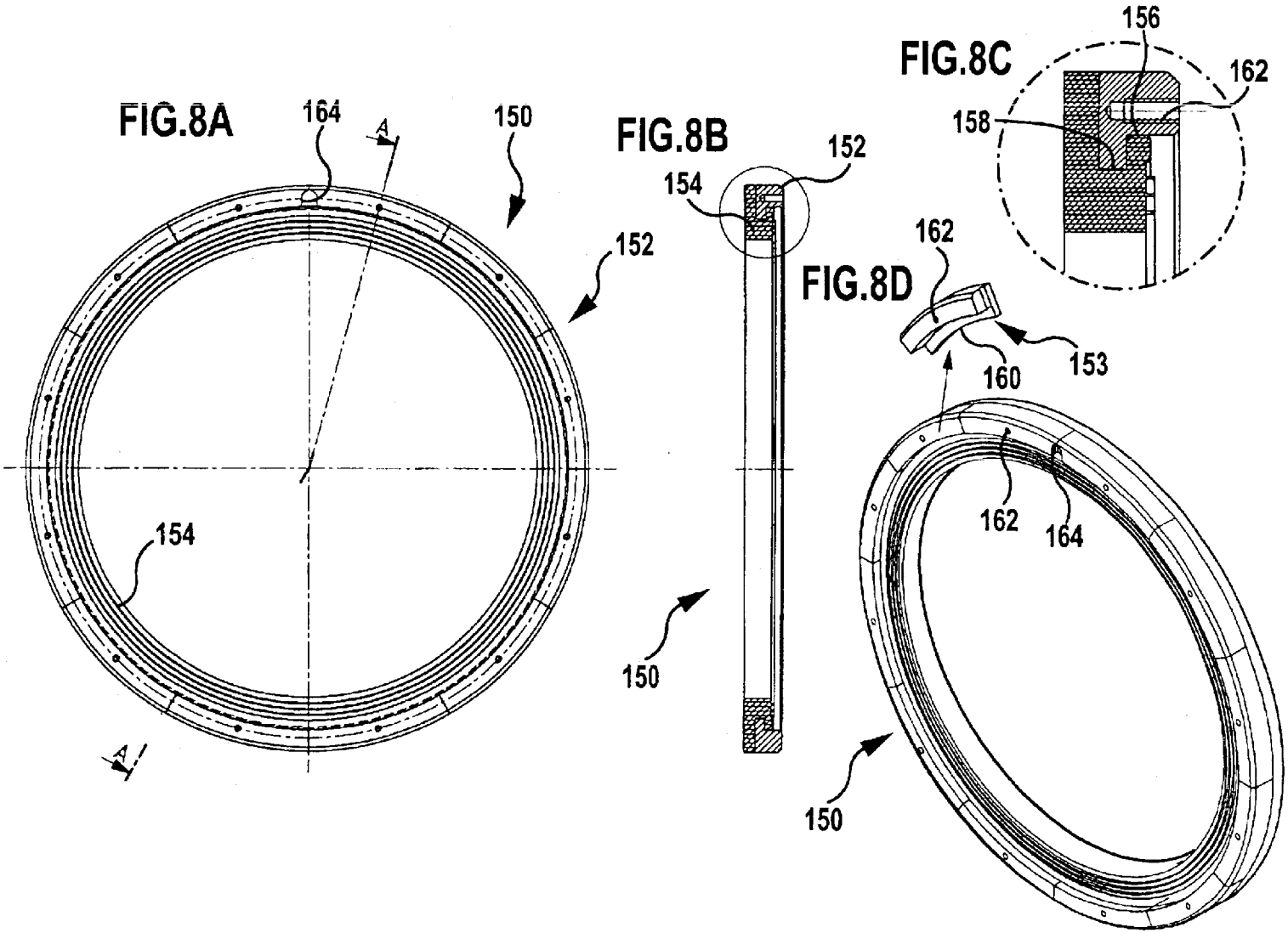
FIGS. 8A to 8D show a further embodiment of the retaining ring according to the invention.
Figures 9A, 9B, 9C, 9D:
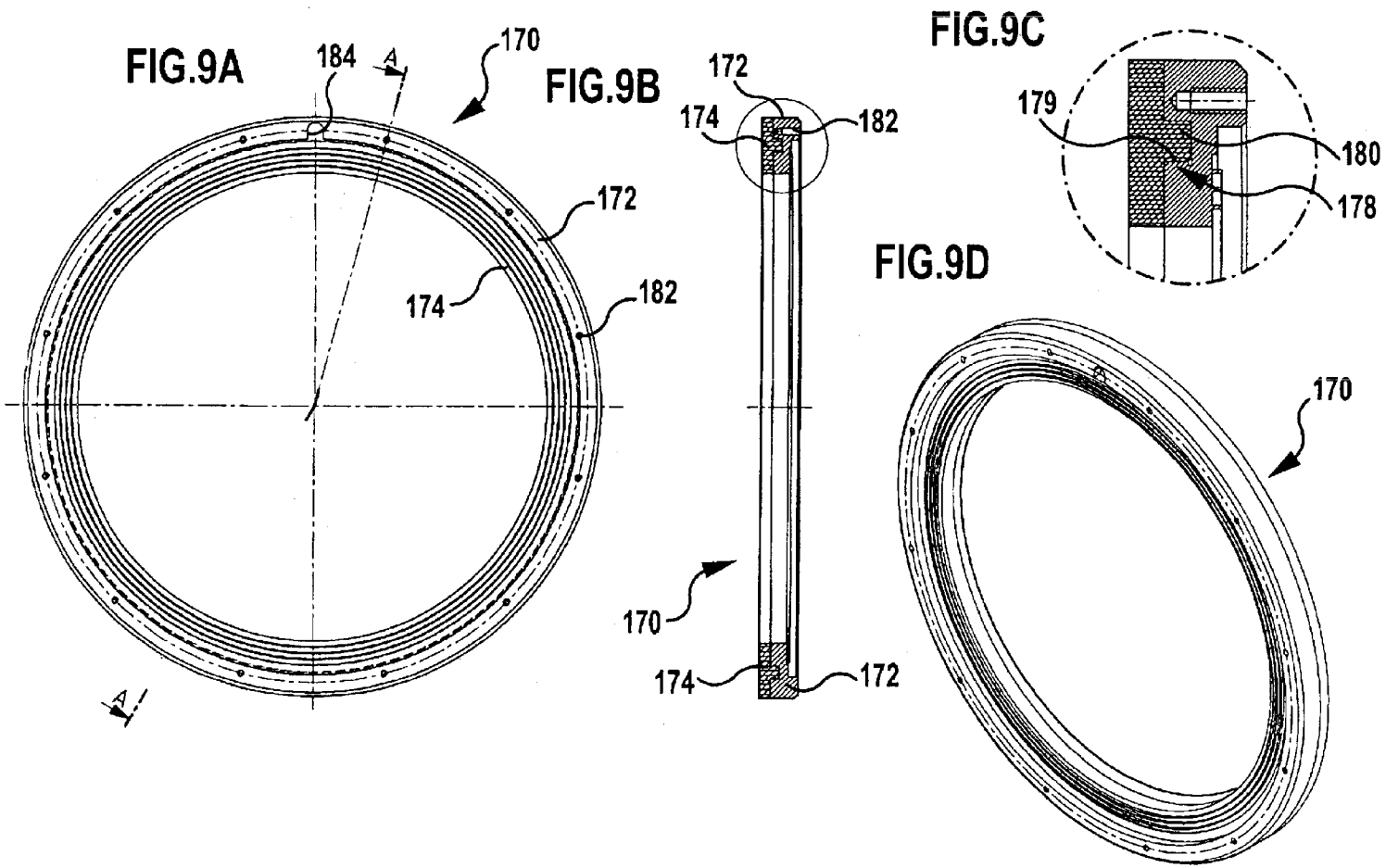
FIGS. 9A to 9D show a further embodiment of the retaining ring according to the invention.

The bearing ring 134 is of integral design and has on its outer circumference 136 a slot 137 extending around the circumference (cf. sectional view taken along line A—A of FIG. 7A as shown in FIG. 7B) and on the side pointing towards the polishing apparatus, at regular angular intervals, open slot-like recesses 138 extending from the outer circumference and in axial direction towards the polishing apparatus.

The carrier ring segments 133 include a flange portion 139 which may, for example, be made of flat material. On its surface pointing towards the polishing apparatus, the flange portion 139 carries a threaded bushing 140 which engages the slot-like recesses 138 upon inserting the flange portion 139 into the ring slot 137 and is thus accessible from the polishing apparatus side for screw connection of the retaining ring 130 (FIG. 7C).

Upon inserting the flange portions 139 into the ring slot 137 on the outer circumference 136 of the bearing ring 134, the flange portions 139 are pressed in so that these are held with a press fit in the bearing ring 134. A securing against rotation is achieved automatically by engagement of the threaded bushings 140 in the slot-like recesses 138 so that no further measures for preventing rotation are necessary here.

In this case, to ensure a specific positioning of the retaining ring 130 in the polishing apparatus, the bearing ring 134 has an opening 142 in which a projection on the polishing apparatus (not shown) engages and thereby effects a definite positioning of the retaining ring 130 in the polishing apparatus.

A further variant of a retaining ring 150 according to the invention with a segmented carrier ring 152 is shown in FIGS. 8A to 8D. Again the bearing ring 154 has in the area of a step 156 a ring groove 158 opening radially outwardly, while the carrier ring 152, which is made up of ring segments 153, carries at its end pointing towards the bearing surface a segment flange pointing radially inwardly. In the fitted state, this ring segment flange 160 engages the ring groove 158 and is pressed in there. Differently from the variant shown in FIGS. 7A to 7D, the threaded bores 162 are incorporated in the ring segments 153, and a corresponding opening 164 is likewise formed by the ring segments 153.

FIGS. 9A to 9D show a further variant of a retaining ring 170 according to the invention with an integral carrier ring 172 and an integral bearing ring 174. In this variant, the carrier ring 172 is provided with a concentric ring groove 176 with a substantially axially parallel wall 178, which is most clearly apparent from the sectional view in FIG. 9B (sectional illustration taken along line A—A of FIG. 9A) and from the detailed illustration in FIG. 9C.

A threaded section 179 is machined in the axially parallel wall 178. The bearing ring 174 has on its side pointing towards the carrier ring side a ring-shaped rib 180 which may also include ring segments. This means that the rib 180 does not have to be provided throughout the entire range of 360°, but can also be formed in sections only. This rib 180 has on its inner, axially parallel wall an internal threaded section with which the bearing ring 174 can be screwed to the carrier ring 172.

In this way, too, carrier ring 172 and bearing ring 174 can be joined with a positive and frictional connection, and, as a rule, a rotationally fixed connection can also be achieved by appropriate choice of the force or torque with which the threaded connection is tightened at the end. The rotationally fixed connection between carrier ring 172 and bearing ring 174 can also be additionally secured by resorting to securing means such as those described in conjunction with FIG. 3D. Again, threaded bores 182 are arranged at regular angular intervals on the carrier ring 172 to enable the retaining ring 170 as a whole to be fitted on the polishing apparatus. An opening 184 for engagement with a corresponding projection on the polishing apparatus again ensures correct orientation of the retaining ring when being fitted on the polishing apparatus.

FIGS. 10A to 10F show a further variant of a retaining ring 190 according to the invention, in which the positive and frictional connection between a carrier ring 192 and a bearing ring 194 is also made by a screw connection. The carrier ring 192 is accommodated in a step 198 set back from the outer circumference 196 and having an axially parallel wall 199 with a threaded section 200 integrated therein. The carrier ring 192 also has on its inner axially parallel surface a threaded section with which it can be screwed to the bearing ring 194. Here again a positive and frictional connection between the carrier ring 192 and the bearing ring 194 can be established by the screw connection, and, as a rule, this connection is adequately fixed against rotation.

Figures 10A, 10B, 10C, 10D, 10E, 10F:
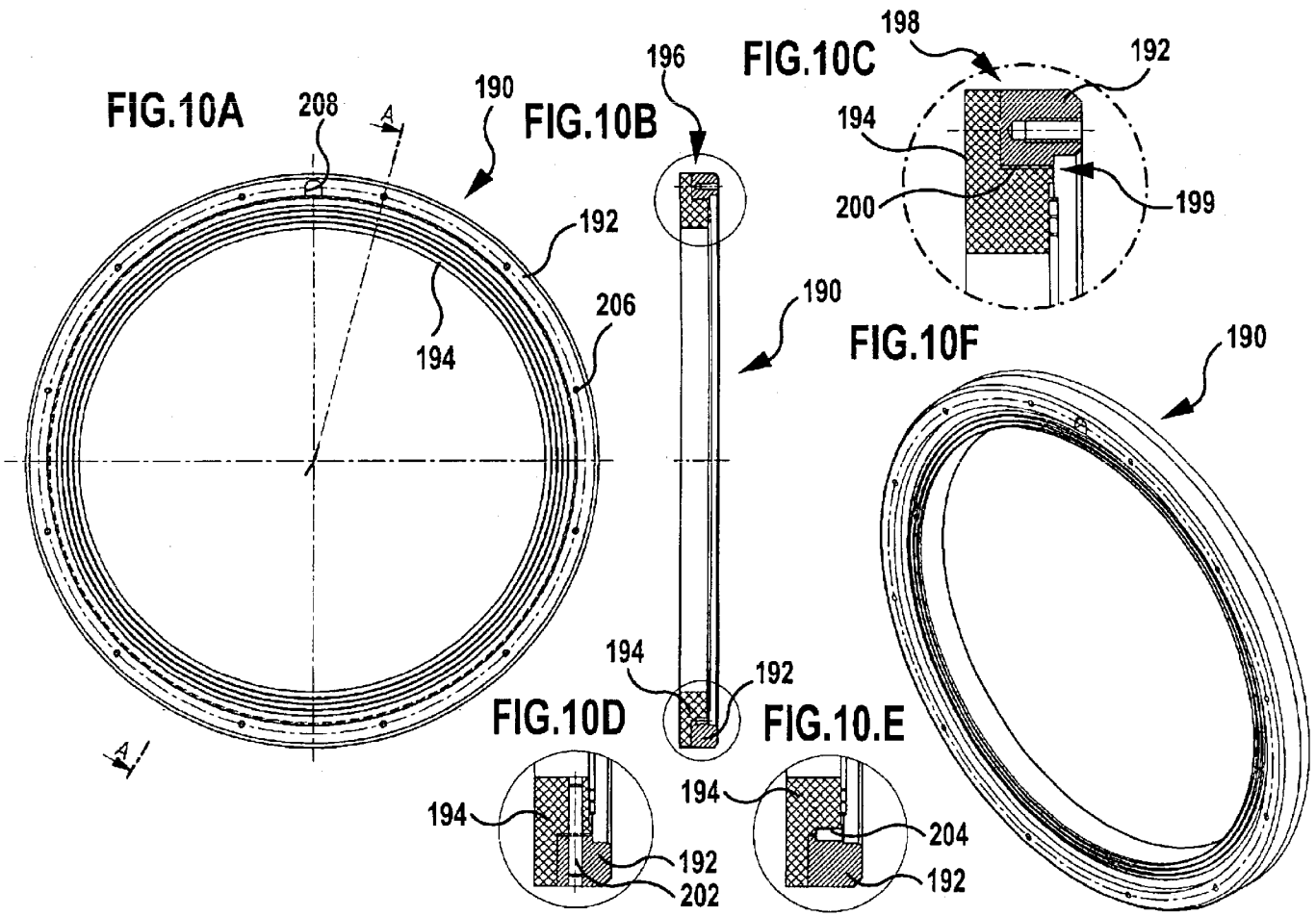
FIGS. 10A to 10F show a further embodiment of the retaining ring according to the invention.
Figures 11A, 11B, 11C, 11D:
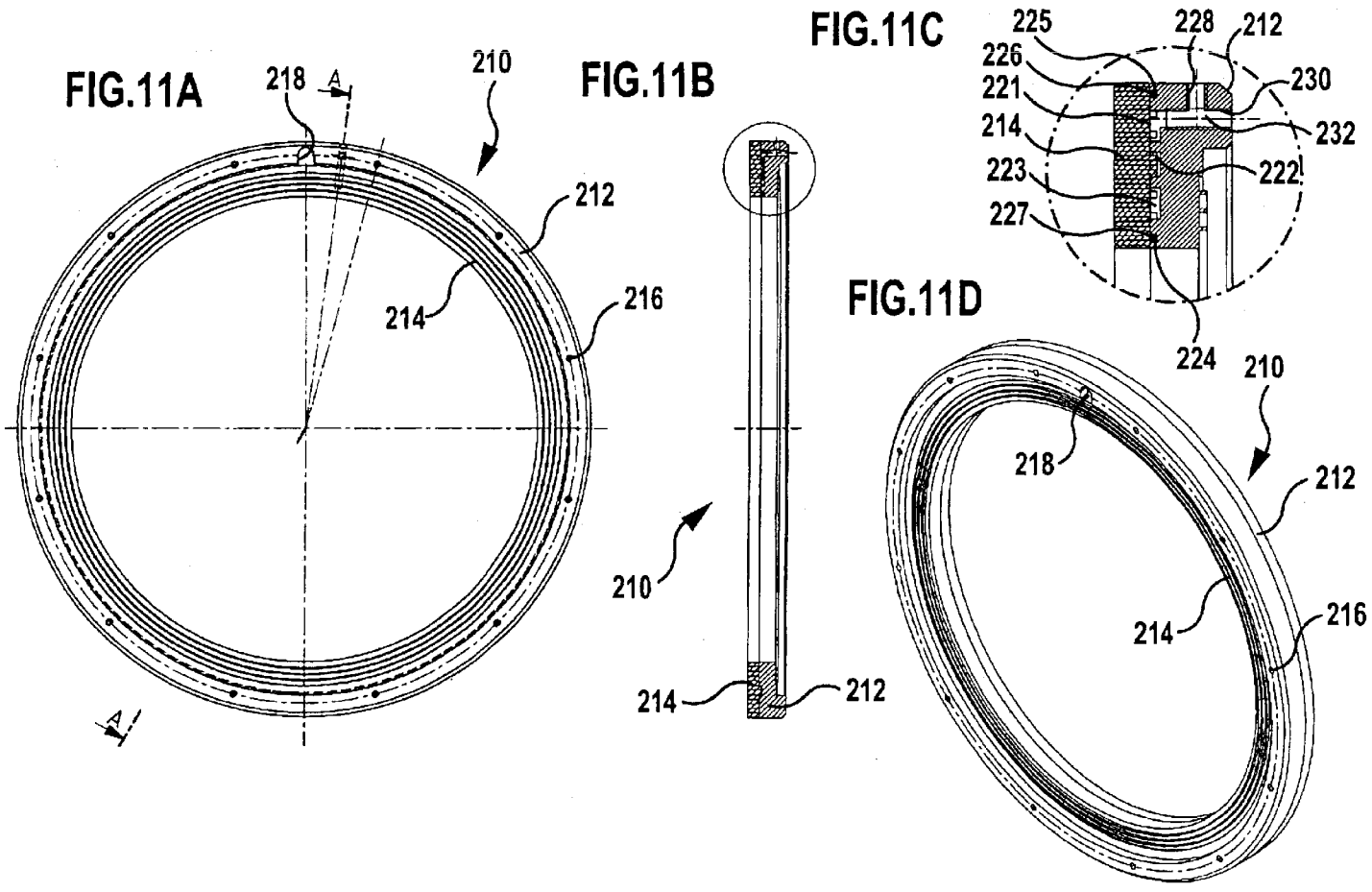
FIGS. 11A to 11D show a further embodiment of the retaining ring according to the invention.

To achieve additional securing against rotation, either flowable, curable material can be introduced into recesses, as shown in FIG. 3D, and cured after assembly has been completed, or, as shown in the variants of FIGS. 10D and 10E, rotation of bearing ring 194 in relation to carrier ring 192 can be prevented by a securing pin or a securing bolt. As shown in FIG. 10D, a radially inserted bolt 202 is provided so as to both extend in radial direction through the carrier ring 192 and engage the bearing ring 194.

An alternative variant for this kind of securing is shown in FIG. 10E, where a securing bolt 204 is inserted in axially parallel arrangement into a bore which is jointly formed by a recess on the carrier ring 192 and a recess on the bearing ring 194. Threaded bores 206 are again arranged on the carrier ring 192 to enable attachment of retaining ring 190 to the polishing apparatus. An opening 208 ensures correct assembly of the retaining ring 190 on the polishing apparatus.

Finally, FIGS. 11A to 11D show a further variant of a retaining ring 210 according to the invention, which is formed by a carrier ring 212 and a bearing ring 214. The carrier ring again has threaded bores 216 arranged at regular angular intervals on its surface pointing towards the polishing apparatus and an opening 218 for ensuring correct positioning of the retaining ring 210 on the polishing apparatus. Here the carrier ring 212 and the bearing ring 214 lie with two substantially parallel surfaces opposite one another, and one or several, in the present case three, concentric ring channels 221, 222, 223 are machined in the surface of the carrier ring 212 (cf. enlarged detailed illustration in FIG. 11C). Arranged adjacent to the radially outer areas of the carrier ring 212, in the shape of rings and concentrically are grooves 224, 225 which receive sealing elements 226, 227. The ring channels 221, 222, 223 are in flow connection with one another (not shown in detail). At at least one location, the carrier ring 212 has a radial bore 228 which meets an axial bore 230 leading from the surface of the carrier ring 212 facing away from the bearing ring 214 into at least one of the ring channels 221, 222 or 223.

A plug 232 can be screwed into the axial bore 230 and initially held in an only slightly screwed-in state in the bore 230. Once the bearing ring 214 is joined to the carrier ring 212, a vacuum can be applied via the radial bore 228 and the volume of the ring channels 221, 222, 223 thereby evacuated. Owing to the vacuum created in the ring channels, the bearing ring 214 can then be readily held on the carrier ring 212. The plug 232 can then be screwed further into the bore 230 so that the radial bore 228 is closed. The vacuum is thus maintained in the ring channels 221, 222, 223 without any need for further evacuation via the radial bore 228. This provides a very simple, releasable connection between the carrier ring 212 and the bearing ring 214, which with a frictional connection ensures a rotationally fixed connection between these two parts of the retaining ring 210.

When exchanging the worn bearing ring 214, the plug 232 then only has to unscrewed until aeration of the ring channels 221, 222, 223 is possible via the radial bore 228. The bearing ring 214 can then be removed from the carrier ring 212 without applying force, and a new bearing ring 214 can be fitted to the carrier ring 212 in the previously described manner.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retaining ring to be fitted on a chemical mechanical polishing apparatus for semiconductor wafers, comprising:

a carrier ring made of a first material and having fitting elements for fitting the carrier ring on the polishing apparatus;

a bearing ring made of a plastic material, arranged concentrically on the carrier ring, the bearing ring resting with a first front side on a polishing surface of the polishing apparatus and being held on its side axially opposed to the first front side releasably, non-rotatably, with a positive and/or frictional connection and without adhesive on the carrier ring;

one or more ring channels formed by complementary aligned surfaces of the bearing and carrier rings in the fitted state thereof;

one or more ring shared sealing elements providing a vacuum tight seal for the one or more ring channels; and a closable opening leading from the outside of the retaining ring to the one or more ring channels, the opening being provided in the carrier ring or the bearing ring;

the first material having a higher rigidity than the plastic material of the bearing ring.

2. The retaining ring in accordance with claim 1, wherein the releasable, non-rotatable, positive and/or frictional connection of the bearing ring and the carrier ring is made in the area of an outer circumferential surface of the bearing ring.

3. The retaining ring according to claim 2, wherein the bearing ring has adjacent to the side of the carrier ring a step set back from the circumference and following the circumference for receiving the carrier ring, and the outer circumferential surface for establishing the positive and/or frictional connection is a circumferential surface of the step.

4. The retaining ring according to claim 3, wherein the carrier ring with its outer circumferential surface is substantially in alignment with the outer circumferential surface of the bearing ring.

5. The retaining ring according to claim 3, wherein the bearing ring has a flange extending around the circumference, projecting radially outwardly and enlarging the bearing surface of the front side of this ring.

6. The retaining ring according to claim 1, wherein, in the joined state, the bearing ring and the carrier ring lie surface-to-surface against one another in predetermined surface portions, and the bearing ring and the carrier ring have complementary projections and recesses for centering the bearing ring and the carrier ring.

7. The retaining ring according to claim 6, wherein the surface portions in which the carrier ring and the bearing ring lie surface-to-surface against one another have a radial orientation.

8. The retaining ring according to claim 6, wherein the complementary projections and recesses of the bearing ring and the carrier ring are arranged on the surface portions on which the carrier ring and the bearing ring lie against one another.

9. The retaining ring according to claim 8, wherein the projections and recesses of the bearing ring and the carrier ring are connectable with a press fit.

10. The retaining ring according to claim 1, wherein the bearing ring has on its outer circumference a circumferential collar pointing in axial direction away from the first front side, lying against the outer circumferential surface of the carrier ring and covering the carrier ring over substantially the entire surface thereof.

11. The retaining ring according to claim 1, wherein the carrier ring has on its surface portion contacting the bearing ring a ring groove having a substantially axially parallel wall with a threaded section thereon, and the bearing ring has on its side axially opposed to the first front side one or several projections arranged complementarily to the ring groove and having a threaded section of complementary design to the threaded section of the axially parallel wall of the groove.

12. The retaining ring according to claim 1, wherein the bearing ring and the carrier ring are provided with cooperating detent means which, when the rings are in the fitted state, form a detent connection and secure the rings against axially acting forces in the fitted state.

13. The retaining ring according to claim 12, wherein the detent connection is designed as securing means against rotation.

14. The retaining ring according to claim 1, wherein the carrier ring and the bearing ring have surface portions of complementary design with which they lie against one another in the fitted state, and the surface portions have projections and recesses of complementary design for joining the rings by a shrinking-in or shrinking-on process.

15. The retaining ring according to claim 1, wherein the bearing ring has on its circumferential surface a ring groove opening radially outwardly, and the carrier ring comprises several ring segments including a flange portion of essentially complementary design to the ring groove and one or more fitting sections which are provided for fitting the carrier ring on the polishing apparatus in axial direction from the side facing away from the bearing surface of the bearing ring.

16. The retaining ring according to claim 15, wherein the fitting sections comprise elements projecting axially from the flange portions.

17. The retaining ring according to claim 16, wherein the groove has in its groove wall facing axially away from the bearing surface of the bearing ring recesses in which the elements of the fitting sections are engageable radially from the outside.

18. The retaining ring according to claim 1, wherein the bearing ring and the carrier ring have on at least one surface portion on which these rings lie against one another a cavity formed by recesses in both the surface of the bearing ring and the surface of the carrier ring and fillable with a curable material.

19. The retaining ring according to claim 1, wherein the bearing ring and the carrier ring are rotationally fixedly connected to one another by a bolt engaging recesses on both the bearing ring and the carrier ring.

20. The retaining ring according to claim 19, wherein the bolt is a threaded bolt, and the recess has an internal threaded section complementary to the outer thread of the threaded bolt.

21. The retaining ring according to claim 19, wherein the bolt is insertable in axial or radial direction into the recess.

22. The retaining ring according to claim 1, wherein the plastic material comprises at least one of a thermoplastic material, a thermosetting plastic material and an elastomer.

23. The retaining ring according to claim 22, wherein the plastic material is a reinforced plastic material.

24. The retaining ring according to claim 23, wherein the plastic material is a fiber-reinforced, plastic material.

25. The retaining ring according to claim 22, wherein abrasion-reducing and/or wear-reducing additives are admixed with the plastic material.

26. The retaining ring according to claim 1, wherein the bearing ring comprises at least two layers or components.

27. The retaining ring according to claim 1, wherein said closable opening is provided in the carrier ring.

28. The retaining ring according to claim 1, wherein said closable opening is provided in the bearing ring.

* * * * *